US009806458B1

(12) United States Patent
Chiu et al.

(10) Patent No.: US 9,806,458 B1
(45) Date of Patent: Oct. 31, 2017

(54) ELECTRICALLY CONNECTING DEVICE, ELECTRICAL CONNECTOR, AND MATING CONNECTOR

(71) Applicant: GT CONTACT CO., LTD., New Taipei (TW)

(72) Inventors: Jui-Jung Chiu, Taoyuan (TW); Chien-Chung Chiu, New Taipei (TW); Chih-Cheng Tsai, New Taipei (TW)

(73) Assignee: GT CONTACT CO., LTD., New Taipei (TW)

( * ) Notice: Subject to any disclaimer, the term of this patent is extended or adjusted under 35 U.S.C. 154(b) by 0 days.

(21) Appl. No.: 15/331,773

(22) Filed: Oct. 21, 2016

(51) Int. Cl.
*H01R 11/30* (2006.01)
*H01R 13/62* (2006.01)
*H01R 13/22* (2006.01)
*H01R 13/40* (2006.01)

(52) U.S. Cl.
CPC ..... *H01R 13/6205* (2013.01); *H01R 13/22* (2013.01); *H01R 13/40* (2013.01)

(58) Field of Classification Search
CPC H01R 13/6205; H01R 2103/00; H01R 13/22; H01R 13/2421
USPC ..... 439/38–40, 188, 289, 700, 824
See application file for complete search history.

(56) References Cited

U.S. PATENT DOCUMENTS 5,921,783 A * 7/1999 Fritsch ..... H01R 13/703 439/38
8,241,043 B1 * 8/2012 Lin ..... H01R 13/6205 439/39
8,449,304 B1 * 5/2013 Lin ..... H01R 13/6205 439/39
8,465,296 B1 * 6/2013 Lin ..... H01R 13/62 439/39
8,529,274 B2 * 9/2013 Li ..... H01R 13/6205 439/38
8,696,366 B2 * 4/2014 Chen ..... H01R 13/6205 439/39
8,727,326 B2 * 5/2014 Lin ..... B25B 11/02 269/8
9,004,924 B2 * 4/2015 Kuo ..... H01R 13/6205 439/188
9,263,828 B2 * 2/2016 Kuo ..... H01R 13/6205

* cited by examiner

*Primary Examiner* — Thanh Tam Le
(74) *Attorney, Agent, or Firm* — Li & Cai Intellectual Property (USA) Office

(57) ABSTRACT

An electrically connecting device includes an electrical connector and a mating connector detachably connected to the electrical connector. The electrical connector includes an insulating base, a central terminal, an outer terminal, and a magnetic member, which are fixed in the insulating base. The outer terminal includes an annular contact having a center located at the central terminal. The mating connector includes an insulating body, a first terminal, a second terminal, and a mating magnetic member, which are fixed in the insulating body. When the electrical connector and the mating connector are relatively rotated along the central terminal in 360 degrees, the magnetic member and the mating magnetic member are configured to attract with each other to form an annularly magnetic region, so that the central terminal and the annular contact are maintained to respectively contact with the first terminal and the second terminal.

8 Claims, 13 Drawing Sheets

ELECTRICALLY CONNECTING DEVICE, ELECTRICAL CONNECTOR, AND MATING CONNECTOR

BACKGROUND OF THE INVENTION

1. Field of the Invention

The instant invention relates to a connector; in particular, to an electrically connecting device, an electrical connector, and a mating connector each being rotatable without orientation.

2. Description of Related Art

The conventional connecting device can be classified into two types. A first type of the conventional connecting device has two connectors inserting to each other just in a single orientation, so the first type is inconvenient for a user. A second type of the conventional connecting device has been improved with respect to the first type. Specifically, the second type of the conventional connecting device has two connectors with dual-orientation for inserting to each other.

However, the two connectors of each type of the conventional connecting device must insert to each other in a specific orientation (single-orientation or dual-orientation), so the user still needs to assemble the two connectors in the specific orientation.

SUMMARY OF THE INVENTION

The instant disclosure provides an electrically connecting device for effectively solving the problem generated from the conventional connecting device.

The instant disclosure provides an electrically connecting device, comprising: an electrical connector including: an insulating base; a terminal set installed to the insulating base and including a central terminal and an outer terminal, wherein the outer terminal includes an annular contact having a center located at the central terminal; and a magnetic member fixed in the insulating base; and a mating connector detachably assembled to the electrical connector, the mating connector including: an insulating body; a mating terminal set installed to the insulating body and including a first terminal and at least one second terminal arranged apart from the first terminal; wherein the central terminal is detachably abutted against the first terminal, and the annular contact of the outer terminal is detachably abutted against the at least one second terminal; and a mating magnetic member fixed in the insulating body, wherein the magnetic member and the mating magnetic member are configured to detachably attract with each other to form an annularly magnetic region, and the annularly magnetic region has a center located at the central terminal; wherein when the electrical connector and the mating connector are relatively rotated along the central terminal in 360 degrees, the central terminal and the annular contact are maintained to respectively contact with the first terminal and the second terminal by using the magnetic member and the mating magnetic member to attract with each other.

The instant disclosure also provides an electrical connector for detachably connecting to a mating connector, comprising: an insulating base; a terminal set installed to the insulating base and including a central terminal and an outer terminal, wherein the outer terminal includes an annular contact having a center located at the central terminal; and a magnetic member fixed in the insulating base; wherein when the electrical connector is rotated with respect to the mating connector along the central terminal in 360 degrees, the magnetic member is configured to detachably attract with a mating magnetic member of the mating connector to form an annularly magnetic region having a center located at the central terminal, so that the terminal set is maintained to contact with a mating terminal set of the mating connector.

The instant disclosure further provides a mating connector for detachably connecting to an electrical connector, comprising: an insulating body including a first slot, an annular second slot, and an annular third slot; a mating terminal set installed to the insulating body and including a first terminal and at least one second terminal arranged apart from the first terminal, wherein an end portion of the first terminal is arranged in the first slot, and an end portion of the at least one second terminal is arranged in the second slot; a mating magnetic member fixed in the insulating body, and part of the mating magnetic member arranged on a bottom of the third slot, wherein each of the first slot, the second slot, and the third slot has a center located at the first terminal; wherein when the mating connector is rotated with respect to the electrical connector along the first terminal in 360 degrees, the mating magnetic member is configured to detachably attract with a magnetic member of the electrical connector to form an annularly magnetic region having a center located at the first terminal, so that the mating terminal set is maintained to contact with a terminal set of the electrical connector.

In summary, the magnetic member of the electrical connector and the mating magnetic member of the mating connector in the instant disclosure are configured to be magnetically attracted with each other to form the annularly magnetic region, so the terminal set can be maintained to contact with the mating terminal set when the electrical connector and the mating connector are relatively rotated, thereby providing the electrically connecting device with non-orientation.

In order to further appreciate the characteristics and technical contents of the instant invention, references are hereunder made to the detailed descriptions and appended drawings in connection with the instant invention. However, the appended drawings are merely shown for exemplary purposes, rather than being used to restrict the scope of the instant invention.

DETAILED DESCRIPTION OF THE PREFERRED EMBODIMENTS

Please refer to FIGS. 1 through 13, which show an embodiment of the instant disclosure. References are hereunder made to the detailed descriptions and appended drawings in connection with the instant invention. However, the appended drawings are merely shown for exemplary purposes, rather than being used to restrict the scope of the instant invention.

Figure 1:
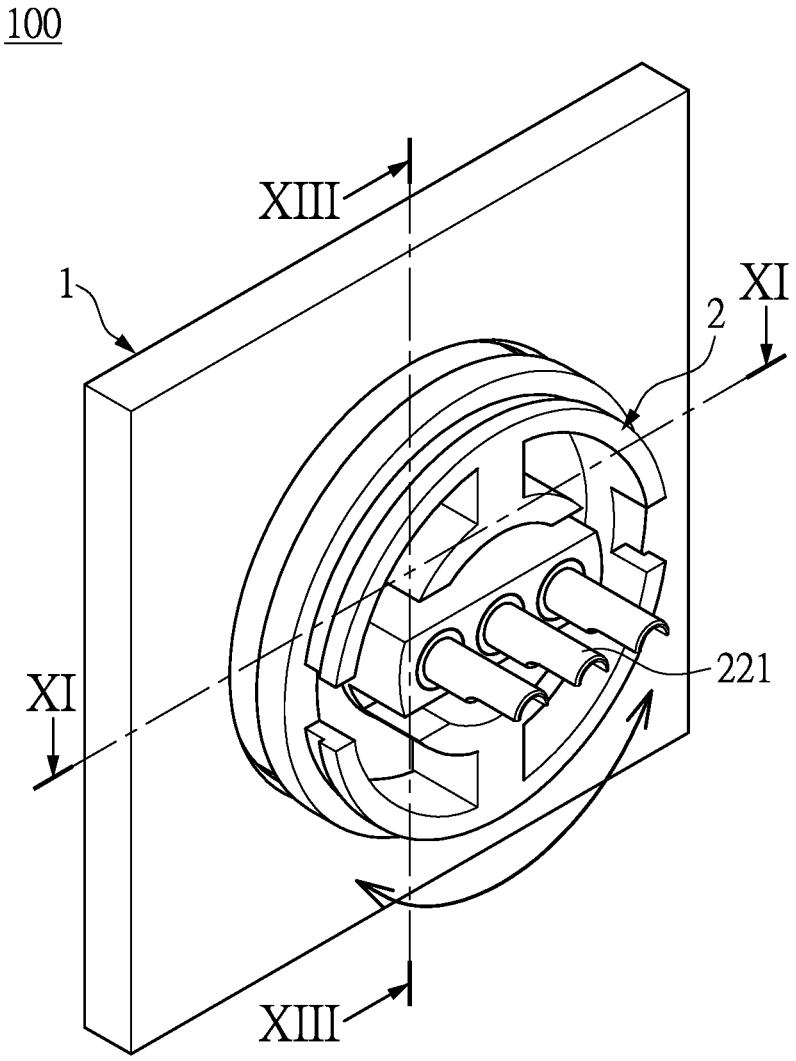
FIG. 1 is a perspective view showing an electrically connecting device according to the instant disclosure.
Figure 2:
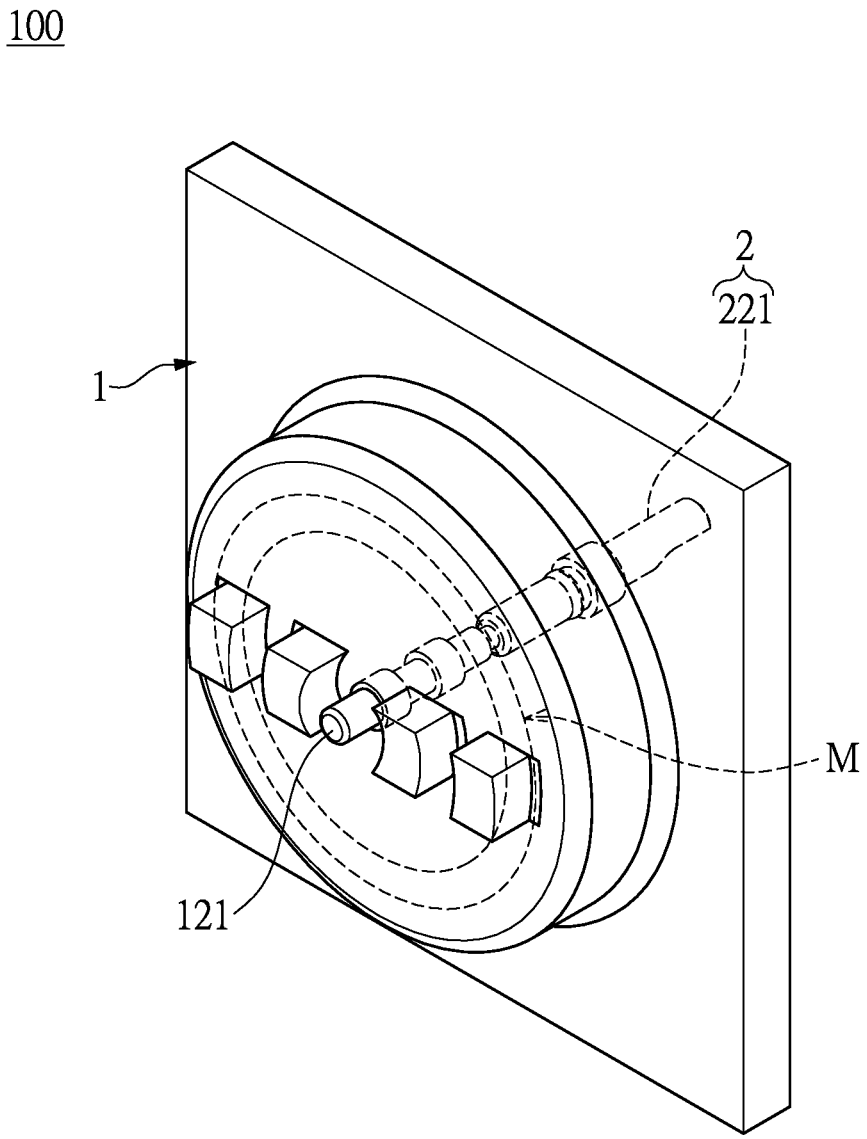
FIG. 2 is a perspective view of FIG. 1 from another perspective.

Please refer to FIGS. 1 and 2, which show an electrically connecting device 100 including an electrical connector 1 and a mating connector 2 detachably assembled to the electrical connector 1. The electrical connector 1 and the mating connector 2 are relatively rotatable with non-orientation, thereby making it more convenient for a user to assemble the electrical connector 1 and the mating connector 2. The following description discloses the construction of each of the electrical connector 1 and the mating connector 2, but the instant disclosure is not limited thereto. For example, part of the electrical connector 1 can be exchanged with a corresponding part of the mating connector 2.

Figure 3:
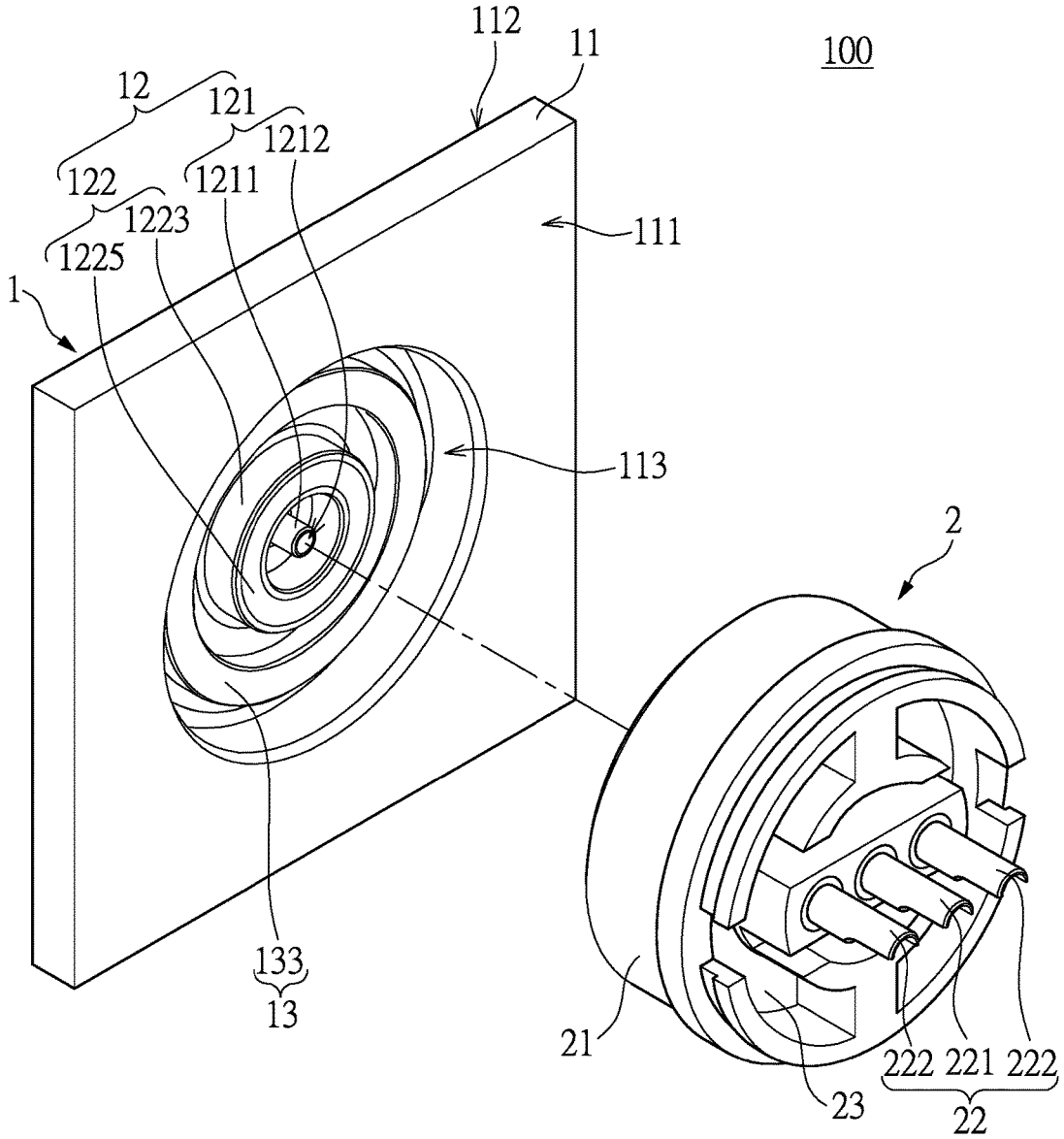
FIG. 3 is an exploded view of FIG. 1.
Figure 4:
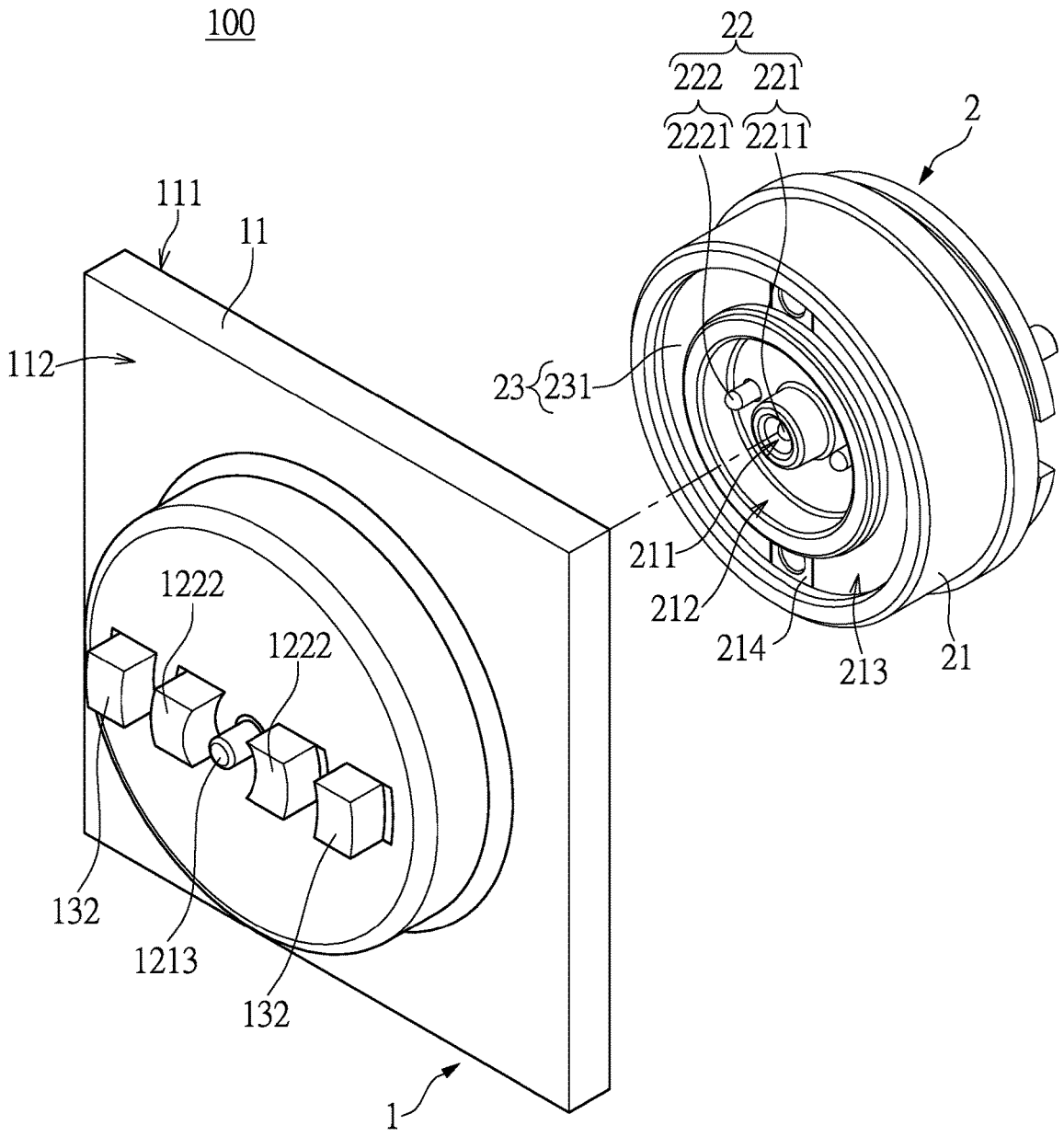
FIG. 4 is an exploded view of FIG. 2.

As shown in FIGS. 3 and 4, the electrical connector 1 includes an insulating base 11, a terminal set 12 fixed in the insulating base 11, a magnetic member 13 fixed in the insulating base 11. The insulating base 11 in the instant embodiment is formed by using an inject molding method to cover part of the terminal set 12 and part of the magnetic member 13, thereby firmly fixing the terminal set 12 and the magnetic member 13 to the insulating base 11, but the instant disclosure is not limited thereto. The insulating base 11 has a circular slot 113 recessed on a front surface 111 thereof for providing an insertion of the mating connector 2.

Figure 5:
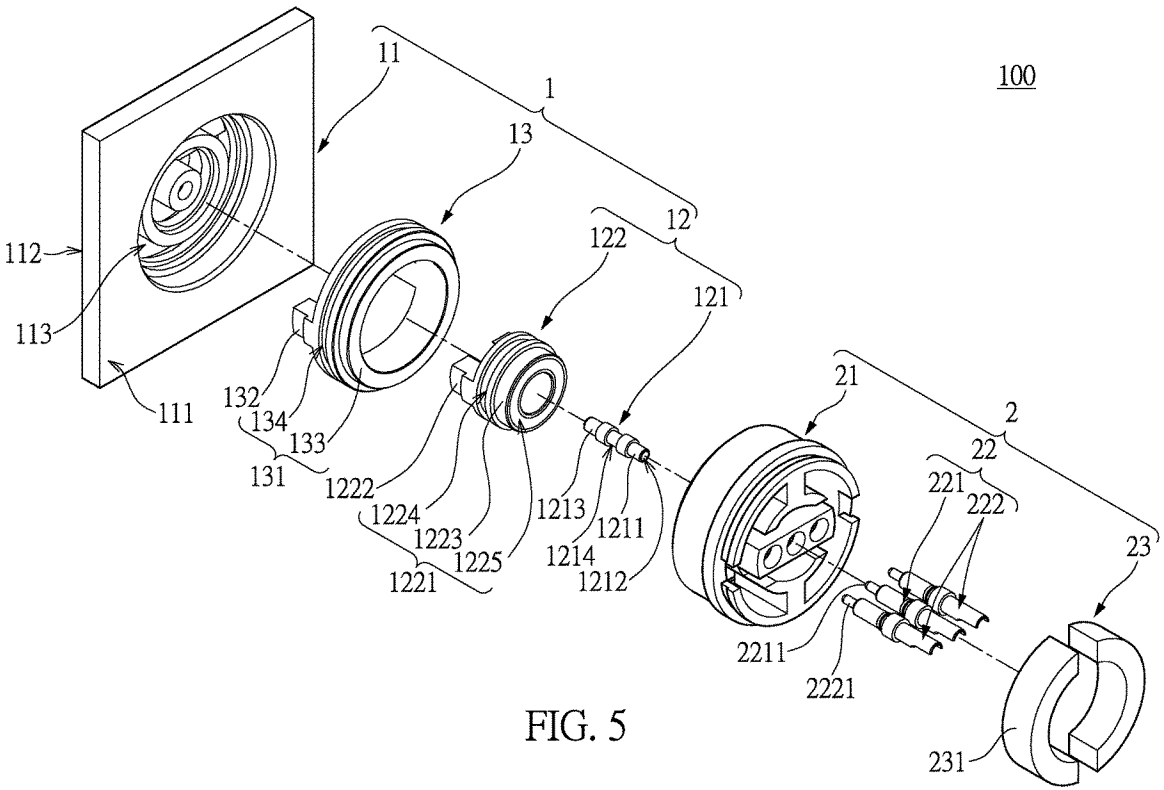
FIG. 5 is an exploded view of FIG. 3.
Figure 6:
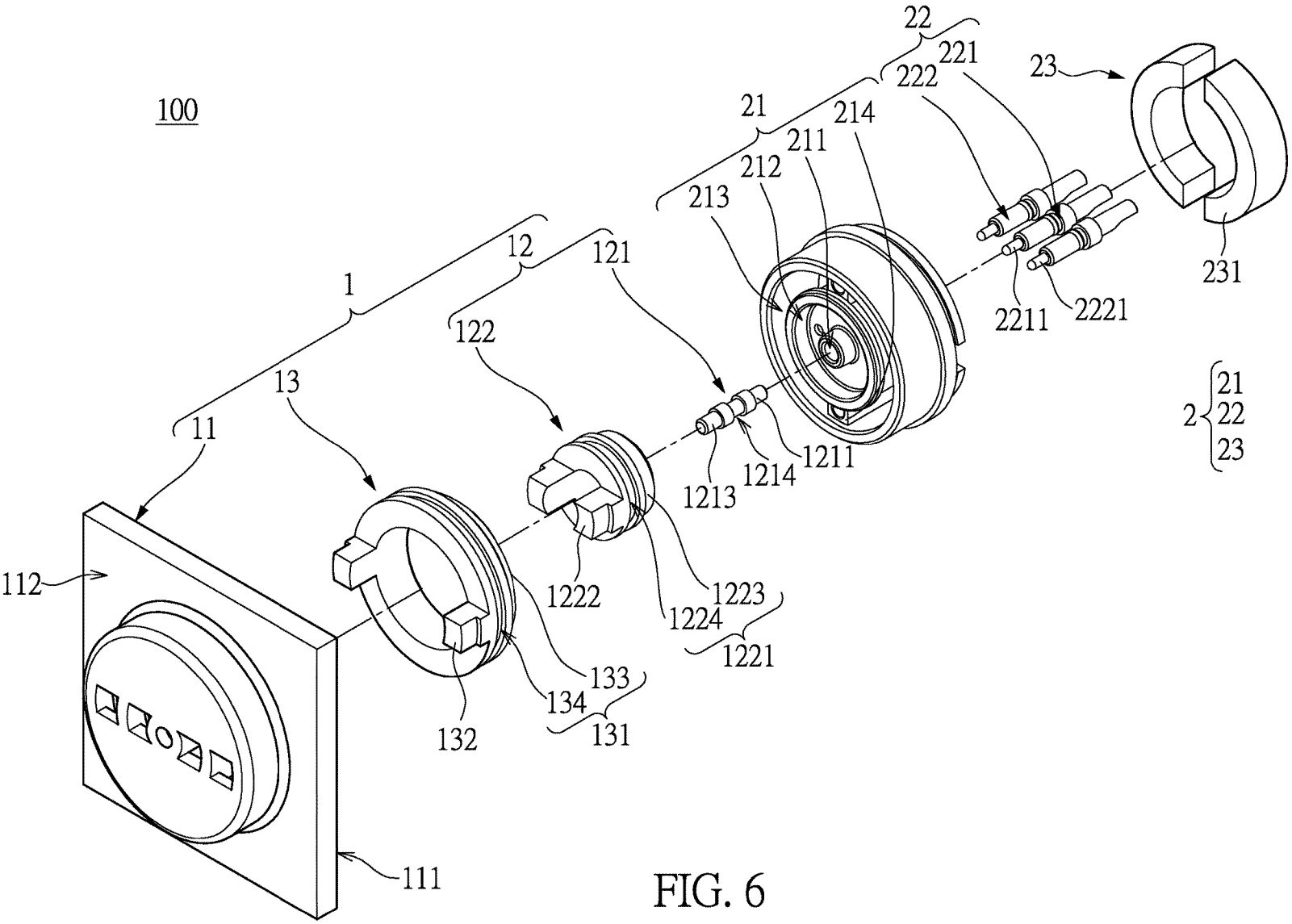
FIG. 6 is an exploded view of FIG. 4.
Figure 7:
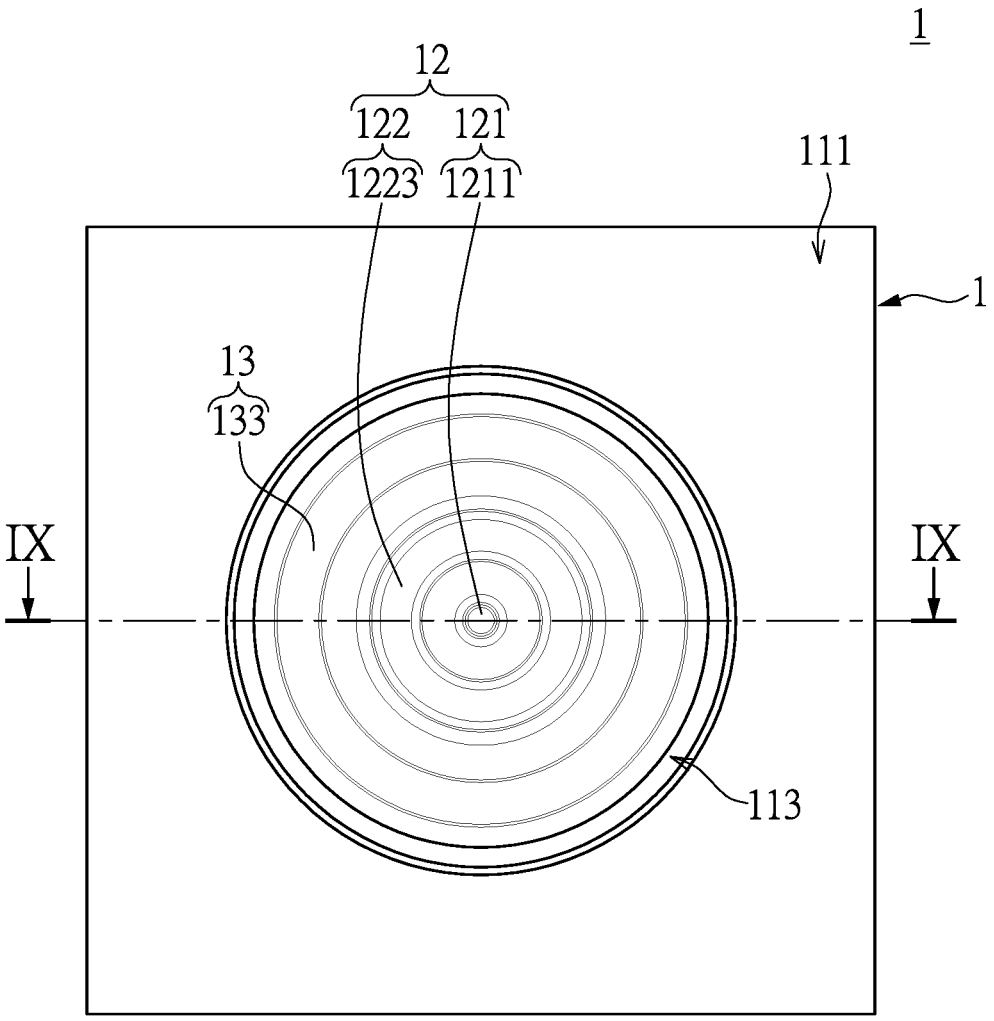
FIG. 7 is a plan view showing an electrical connector according to the instant disclosure.

As shown in FIGS. 5 through 7, the terminal set 12 includes an elongated central terminal 121 and an outer terminal 122 arranged apart from the central terminal 121. An end portion (hereafter referred as front end portion 1211) of the central terminal 121 is arranged in the circular slot 113. A trough 1212 is recessed on an end (of the front end portion 1211) of the central terminal 121. A center of the circular slot 113 of the insulating base 11 is located at (the front end portion 1211) of the central terminal 121. The other end portion (hereafter referred as rear end portion 1213) of the central terminal 121 is protruded from a rear surface 112 of the insulating base 11 (as shown in FIG. 4). Moreover, a portion of the central terminal 121 embedded in the insulating base 11 has an annular concavity 1214 recessed on an outer surface thereof, such that the central terminal 121 can be firmly fixed to the insulating base 11.

The outer terminal 122 includes an annular main portion 1221 and two inserting legs 1222 integrally extended from the main portion 1221. The main portion 1221 has a center located at the central terminal 121, and the main portion 1221 includes an annular contact 1223 arranged in the circular slot 113 and having a center located at the central terminal 121. A portion of the main portion 1221 embedded in the insulating base 11 has an annular concavity 1224 recessed on an outer surface thereof. Specifically, the annular contact 1223 and the two inserting legs 1222 are respectively arranged on two opposite sides of the outer terminal 122, and at least part of each inserting leg 1222 is arranged outside the insulating base 11. An annular groove 1225 is recessed on an end of the annular contact 1223 of the outer terminal 122 (as shown in FIG. 5).

The magnetic member 13 includes an annular structure 131 having a center located at the central terminal 121 and two mounting legs 132 extended from the annular structure 131. The annular structure 131 of the magnetic member 13 has an end portion 133 arranged in the circular slot 113 and having a center located at the central terminal 121. A portion of the annular structure 131 embedded in the insulating base 11 has an annular concavity 134 recessed on an outer surface thereof. Specifically, the end portion 133 of the annular structure 131 and the mounting legs 132 are respectively arranged on two opposite sides of the magnetic member 13, and at least part of each mounting leg 132 is arranged outside the insulating base 11 (as shown in FIG. 4).

Figure 9:
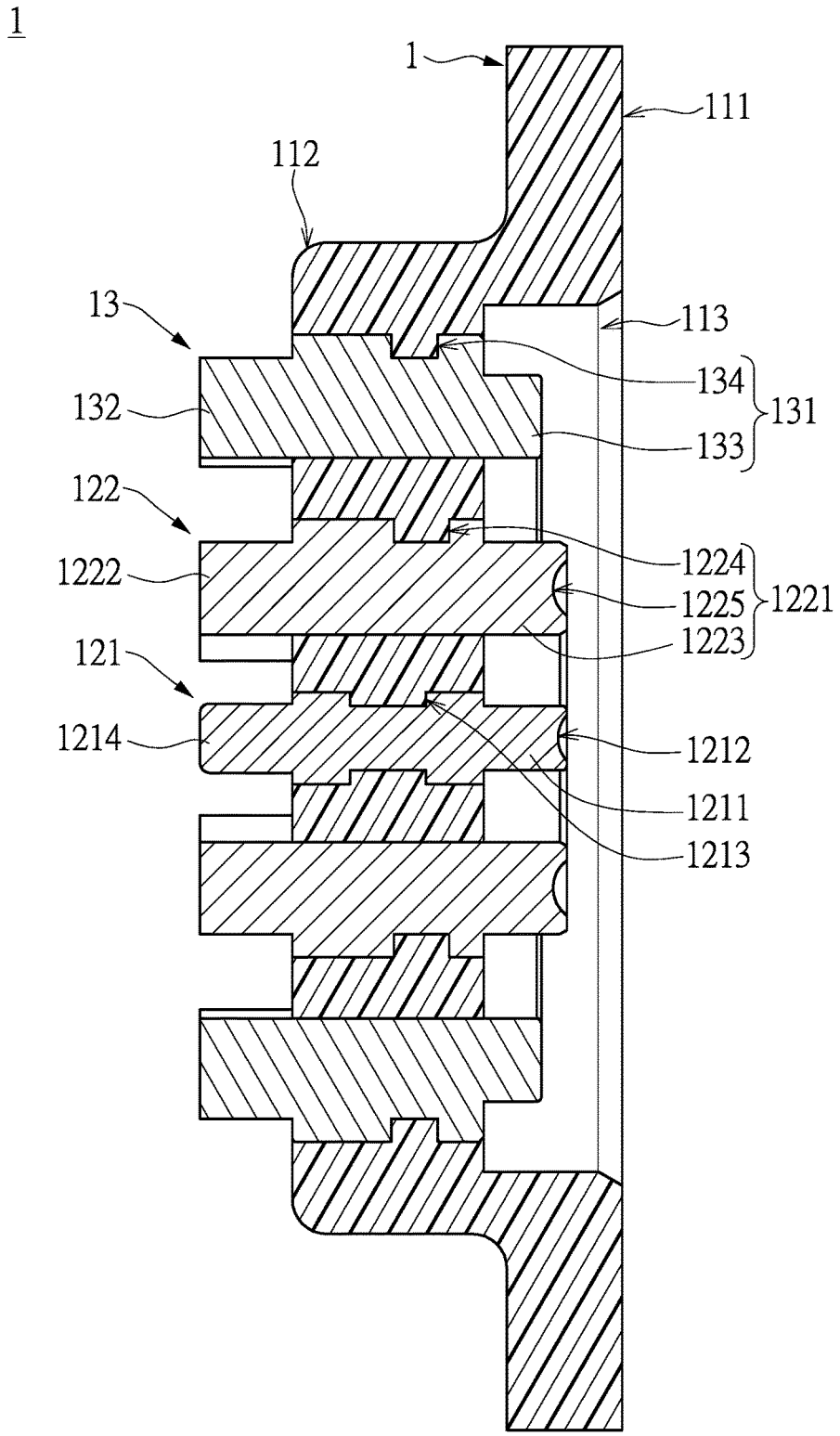
FIG. 9 is a cross-sectional view of FIG. 7 along line IX-IX.

Moreover, the end of the central terminal 121 (i.e., the trough 1212) and the end of the outer terminal 122 (i.e., the annular groove 1225) are higher than the magnetic member 13 with respect to a bottom of the circular slot 113 (as shown in FIG. 9). That is to say, as shown in FIG. 9, a distance between the trough 1212 of the central terminal 121 and the bottom of the annular slot 113 is more than a distance between the end portion 133 of the magnetic member 13 and the bottom of the annular slot 113, and a distance between the annular groove 1225 of the outer terminal 122 and the bottom of the annular slot 113 is more than the distance between the end portion 133 of the magnetic member 13 and the bottom of the annular slot 113. The distance between the trough 1212 of the central terminal 121 and the bottom of the annular slot 113 is substantially equal to the distance between the annular groove 1225 of the outer terminal 122 and the bottom of the annular slot 113, but the instant disclosure is not limited thereto. The rear end portion 1213 of the central terminal 121, the two inserting legs 1222 of the outer terminal 122, and the mounting legs 132 of the magnetic member 13 are arranged in one row perpendicular to the central terminal 121.

In addition, the electrical connector 1 is preferably symmetrical to the central terminal 121. The electrical connector 1 in the instant embodiment is a 2-fold symmetrical structure with respect to the central terminal 121, but the instant disclosure is not limited thereto.

As shown in FIGS. 3 and 4, the mating connector 2 includes an insulating body 21, a mating terminal set 22 fixed in the insulating body 21, and a mating magnetic member 23 fixed in the insulating body 21. The mating terminal set 22 and the mating magnetic member 23 are inserted into the insulating body 21, and then an insulating material (not shown) is formed to cover a rear portion of the insulating body 21, part of the mating terminal set 22, and part of the mating magnetic member 23 by using an inject molding method, such that the mating terminal set 22 and the mating magnetic member 23 can be firmly fixed in the insulating body 21, but the instant disclosure is not limited thereto. The insulating body 21 includes a first slot 211, an annular second slot 212, and an annular third slot 213.

Figure 8:
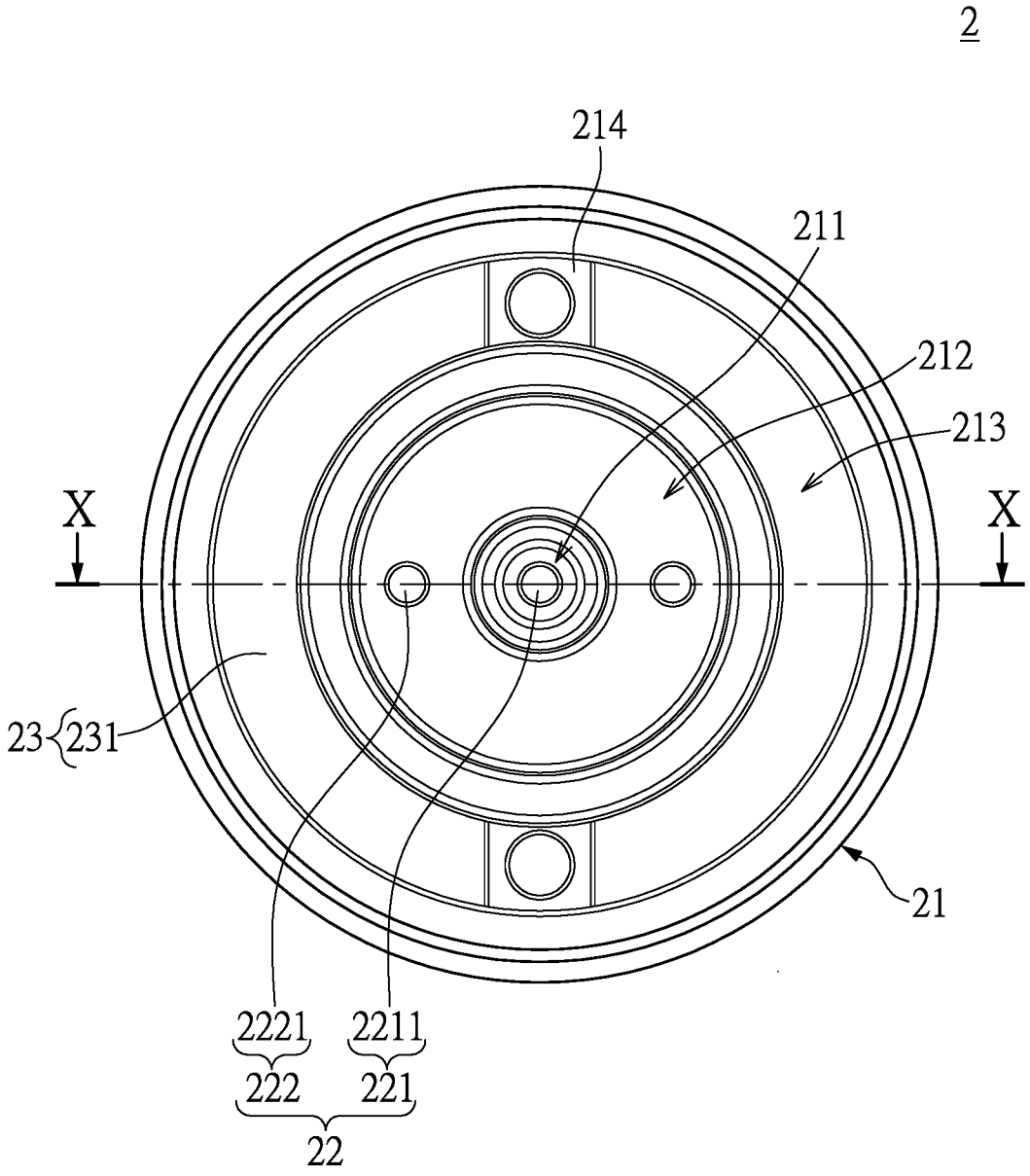
FIG. 8 is a plan view showing a mating connector according to the instant disclosure.
Figure 10:
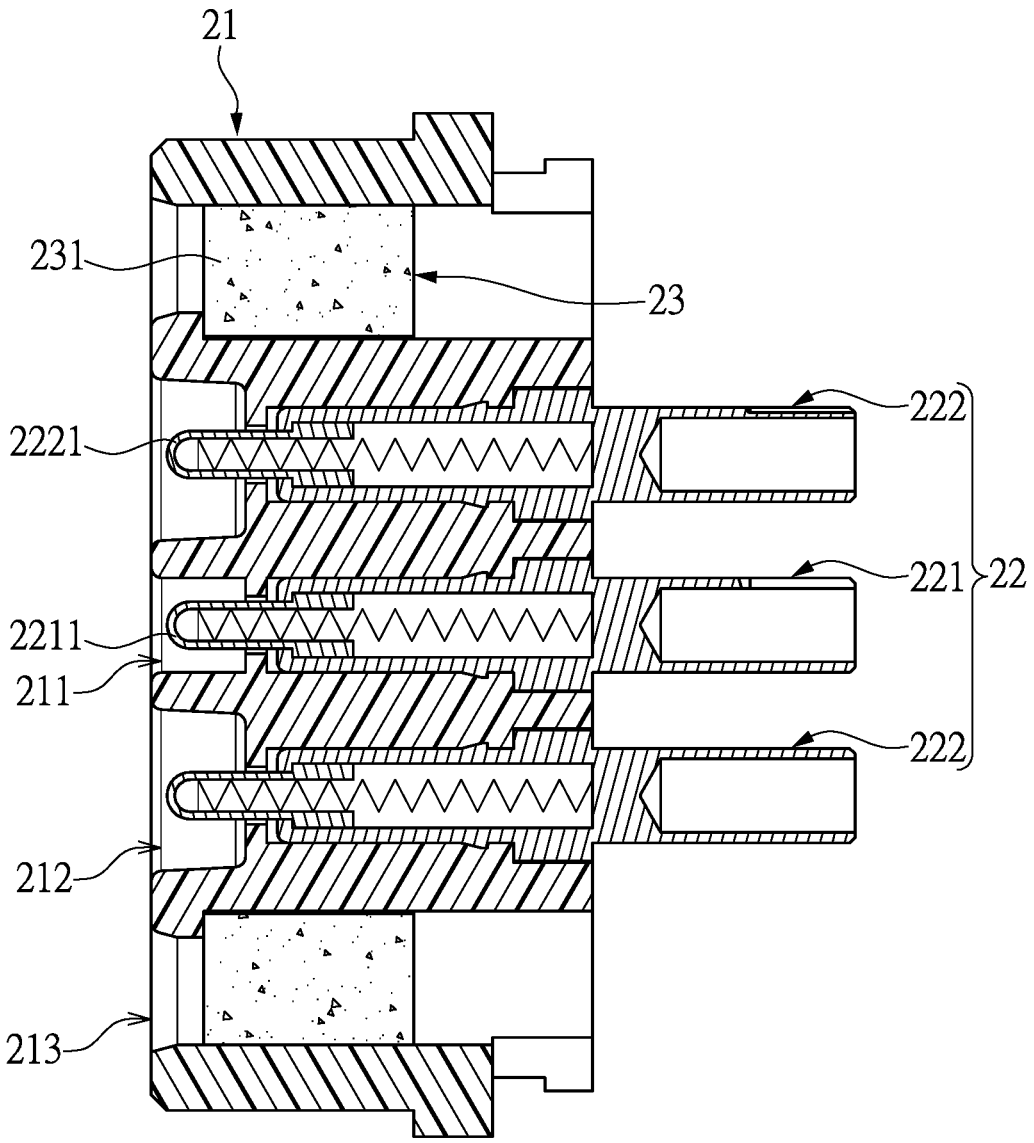
FIG. 10 is a cross-sectional view of FIG. 8 along line X-X.
Figure 11:
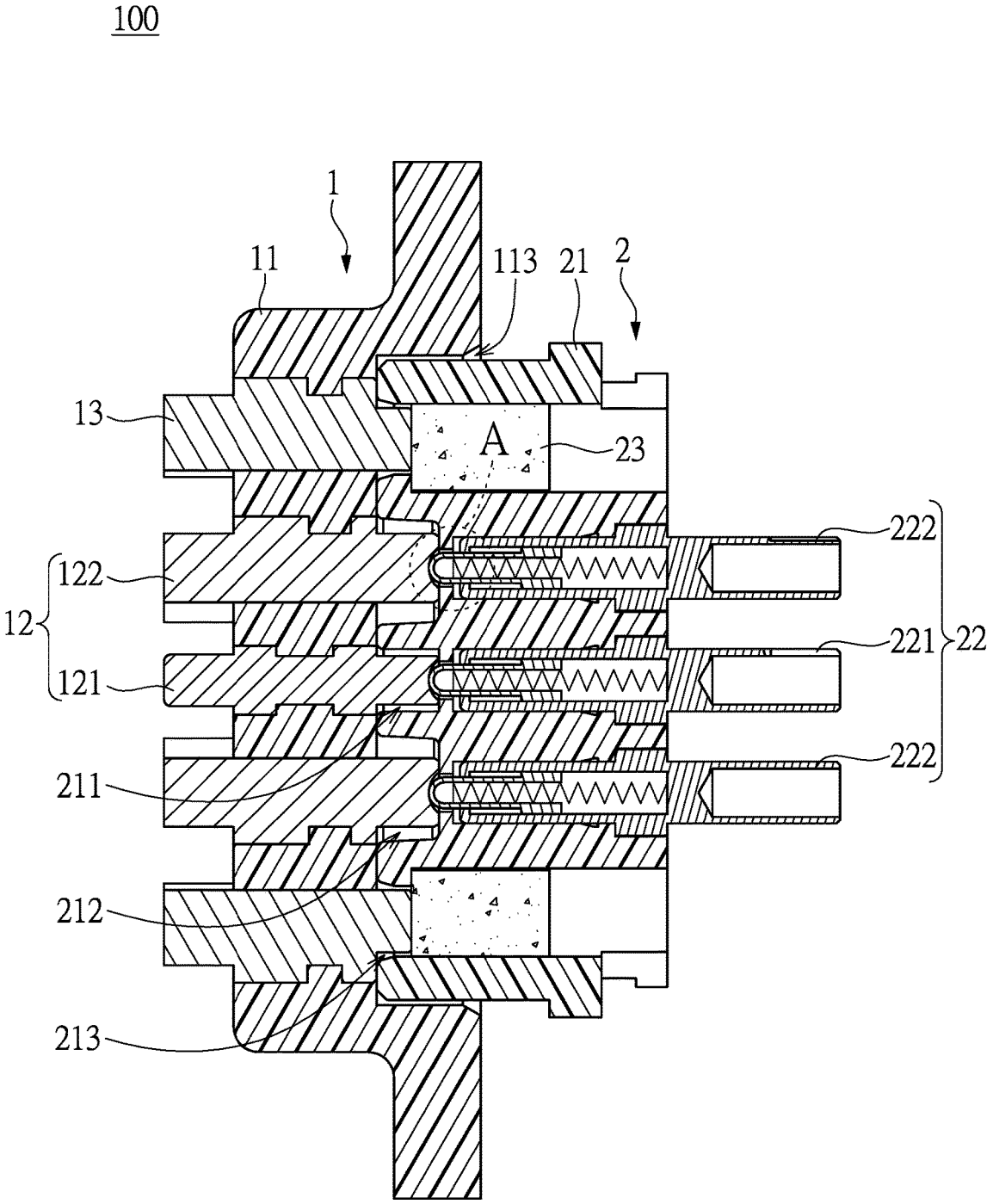
FIG. 11 is a cross-sectional view of FIG. 1 along line XI-XI.
Figure 12:
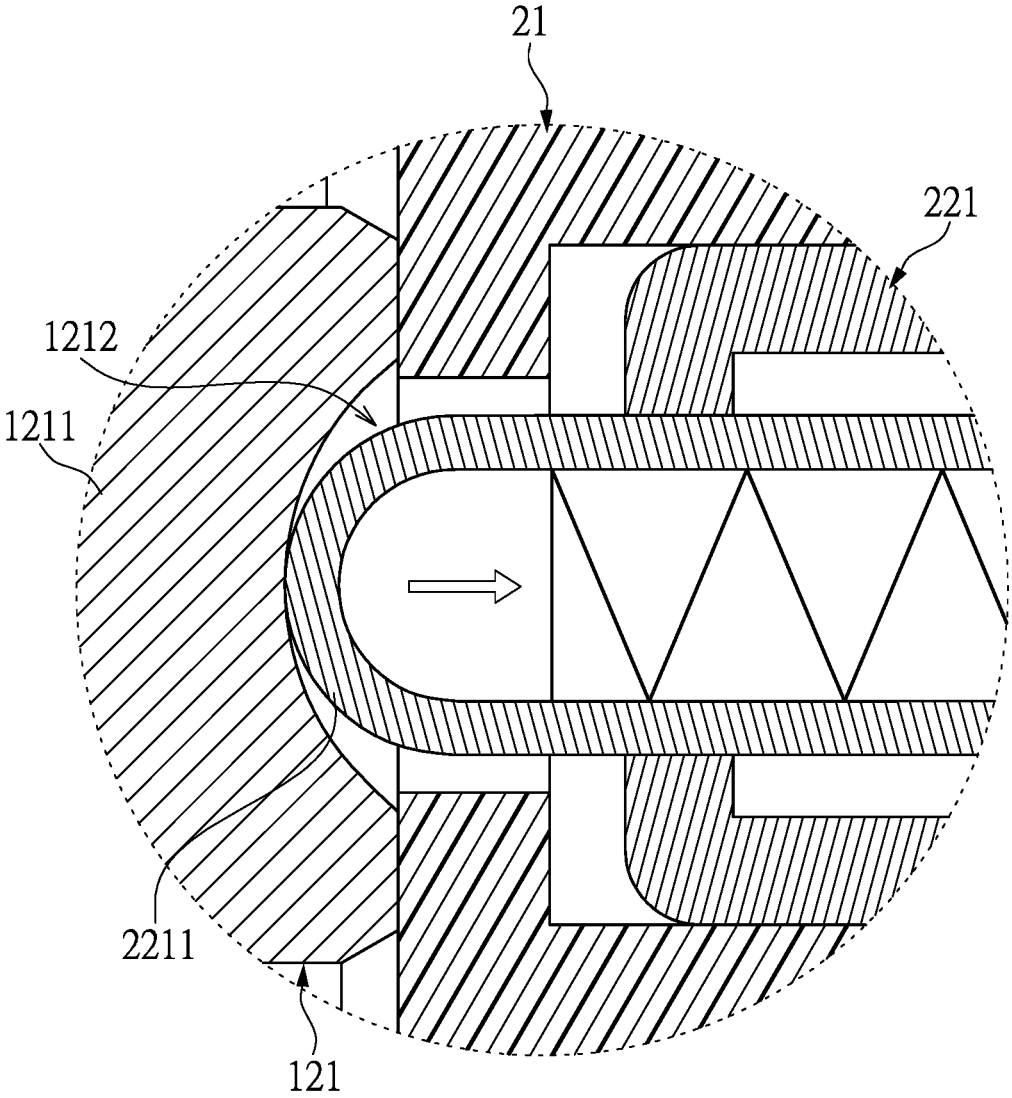
FIG. 12 is an enlarged view of FIG. 11.
Figure 13:
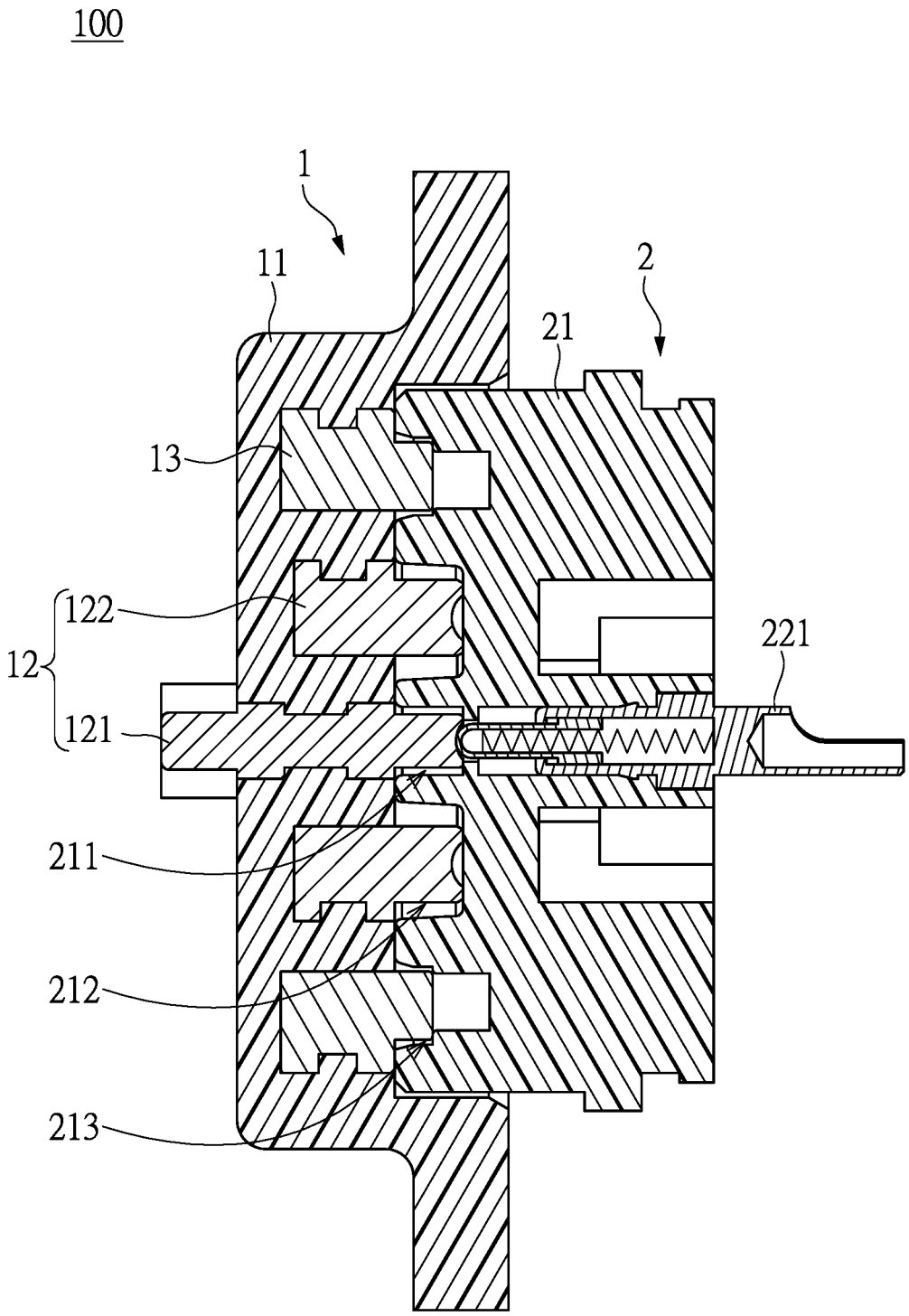
FIG. 13 is a cross-sectional view of FIG. 1 along line XIII-XIII.

As shown in FIGS. 5, 6, and 8, the mating terminal set 22 includes an elongated first terminal 221 and at least one elongated second terminal 222 arranged apart from the first terminal 221. Each of the first terminal 221 and the at least one second terminal 222 in the instant embodiment is a pogo pin and has a movable contact portion 2211, 2221 (as shown in FIG. 10). That is to say, each contact portion 2211, 2221 is movable with respect to the insulating body 21. An end portion (i.e., the contact portion 2211) of the first terminal 221 is arranged in the first slot 211 of the insulating body 21, and an end portion (i.e., the contact portion 2221) of the at least one second terminal 222 is arranged in the second slot 212 of the insulating body 21 (as shown in FIG. 4). Each of the first slot 211, the second slot 212, and the third slot 213 has a center located at the first terminal 221.

It should be noted that the number of the at least one second terminal 222 of the mating terminal set 22 in the instant embodiment is two, and the first terminal 221 and the two second terminals 222 are arranged in one row substantially perpendicular to the first terminal 221, but the instant disclosure is not limited thereto.

Part of the mating magnetic member 23 is arranged on a bottom of the third slot 213. At least one of the magnetic member 13 and the mating magnetic member 23 is a magnet, and the other one is formed of a material, which is attractable to the magnet. Specifically, in the instant embodiment, the magnetic member 13 is a metal, and the mating magnetic member 23 is a magnet, but the instant disclosure is not limited thereto. Moreover, "the part of the mating magnetic member 23 arranged on a bottom of the third slot 213" means that a magnetic force generated from the mating magnetic member 23 can be emitted from the third slot 213.

Specifically, the insulating body 21 includes two positioning portions 214 corresponding to the third slot 213, and the mating magnetic member 23 includes two C-shaped magnets 231. Two ends of each of the two C-shaped magnets 231 are respectively connected to the two positioning portions 214, and the bottom of the third slot 213 is formed by the two positioning portions 214 and the two C-shaped magnets 231. Each positioning portion 214 is preferably formed flush with or lower than each C-shaped magnet 231 (as shown in FIG. 4), in other words, the bottom of the third slot 213 can be a plane. Moreover, as show in FIG. 10, (the ends of) the contact portions 2211, 2221 of the first terminal 221 and the second terminals 222 in the instant embodiment are higher than the mating magnetic member 23 (or the bottom of the third slot 213) with respect to a bottom of the first slot 211.

In addition, the mating connector 2 is preferably symmetrical to the first terminal 221. The mating connector 2 in the instant embodiment is a 2-fold symmetrical structure with respect to the first terminal 221, but the instant disclosure is not limited thereto.

The constructions of the electrical connector 1 and the mating connector 2 have been disclosed in the above description, and the following description discloses a related feature of the electrical connector 1 and the mating connector 2.

Please refer to FIGS. 9 through 13. The insulating body 21 of the mating connector 2 is detachably inserted into the circular slot 113 of the insulating base 11 of the electrical connector 1. In other words, the central terminal 121, the outer terminal 122, and the magnetic member 13 of the electrical connector 1 are respectively inserted into the first slot 211, the second slot 212, and the third slot 213 of the mating connector 2. The central terminal 121 is detachably abutted against the first terminal 221, and the annular contact 1223 of the outer terminal 122 is detachably abutted against the at least one second terminal 222.

Specifically, the contact portions 2211, 2221 of the first terminal 221 and the at least one second terminal 222 are respectively abutted against the central terminal 121 and the annular contact 1223 of the outer terminal 122. The contact portion 2211 of the first terminal 221 is abutted against the trough 1212 of the central terminal 121, and the contact portion 2221 of the at least one second terminal 222 is abutted against the annular groove 1225 of the outer terminal 122. The contact portions 2211, 2221 are movable with respect to the insulating body 21 when being pressed, so the magnetic attraction of the magnetic member 12 and the mating magnetic member 23 and the structural connection of the terminal set 12 and the mating terminal set 22 can be effectively maintained.

The magnetic member 13 and the mating magnetic member 23 are detachably attracted with each other to form an annularly magnetic region M (as shown in FIG. 2) having a center located at the central terminal 121 or/and first terminal 221. The annularly magnetic region M in the instant embodiment has a radius greater than a radius of the annular contact 1223. In other words, a radius of the annular structure 131 in the instant embodiment is greater than that of the annular contact 1223, and a radius of the third slot 213 is greater than that of the second slot 212, but the instant disclosure is not limited thereto. For example, in a non-shown embodiment, the radius of the annularly magnetic region M can be less than that of the annular contact 1223, in the other words, the radius of the annular structure 131 in the instant embodiment is less than that of the annular contact 1223, and the radius of the third slot 213 is less than that of the second slot 212.

Moreover, the annularly magnetic region M means a magnetically attracted region between the magnetic member 13 and the mating magnetic member 23 when the magnetic member 13 is rotated with respect to the mating magnetic member 23. Thus, at least one of the magnetic member 13 and the mating magnetic member 23 is preferably an annular shape for forming the annularly magnetic region M, and the other one can be any shape. In the instant embodiment, the magnetic member 13 is provided with the annular structure 131 for forming the annularly magnetic region M, but the instant disclosure is not limited thereto. For example, in a non-shown embodiment, the mating magnetic member 23 can be formed with an annular shape for forming the annularly magnetic region M.

Accordingly, when the electrical connector 1 and the mating connector 2 are relatively rotated along the central terminal 121 or/and the first terminal 221 in 360 degrees (i.e., non-orientation), the central terminal 121 and the outer terminal 122 of the terminal set 12 are maintained to respectively contact with the first terminal 221 and the at least one second terminal 222 of the mating terminal set 22 by using the magnetic member 13 and the mating magnetic member 23 to attract with each other.

[The Effect of the Instant Embodiments]

In summary, the magnetic member of the electrical connector and the mating magnetic member of the mating connector in the instant disclosure are configured to be attracted with each other to form the annularly magnetic region, so the terminal set can be maintained to contact with the mating terminal set when the electrical connector and the mating connector are relatively rotated, thereby providing the electrically connecting device with non-orientation.

Moreover, each of the first terminal and the second terminal of the mating connector is a pogo-pin, so the contact portions can move with respect to the insulating body when being pressed, thereby the magnetic attraction of the magnetic member and the mating magnetic member and the structural connection of the terminal set and the mating terminal set can be effectively maintained.

In addition, the radius of the annularly magnetic region in the instant embodiment is greater than that of the annular contact, so the electrically connecting device is provided with a larger magnetic force, thus the electrical connector can be firmly attracted to the mating connector.

Furthermore, the insulating body of the mating connector in the instant embodiment is a single piece made by the forming of positioning portions, so the mating connector can be manufactured by inserting the mating terminal set and the mating magnetic member into the insulating body and then forming an insulating material to fix the mating terminal set and the mating magnetic member, thereby effectively reducing the manufacturing cost of the mating connector.

The descriptions illustrated supra set forth simply the preferred embodiments of the instant invention; however, the characteristics of the instant invention are by no means restricted thereto. All changes, alterations, or modifications conveniently considered by those skilled in the art are deemed to be encompassed within the scope of the instant invention delineated by the following claims.

What is claimed is:

1. An electrically connecting device, comprising:

an electrical connector including:

an insulating base;

a terminal set installed to the insulating base and including a central terminal and an outer terminal, wherein the outer terminal includes an annular contact having a center located at the central terminal; and a magnetic member fixed in the insulating base; and a mating connector detachably assembled to the electrical connector, the mating connector including:

an insulating body;

a mating terminal set installed to the insulating body and including a first terminal and at least one second terminal arranged apart from the first terminal; wherein the central terminal is detachably abutted against the first terminal, and the annular contact of the outer terminal is detachably abutted against the at least one second terminal; and a mating magnetic member fixed in the insulating body, wherein the magnetic member and the mating magnetic member are configured to detachably attract with each other to form an annularly magnetic region, and the annularly magnetic region has a center located at the central terminal;

wherein when the electrical connector and the mating connector are relatively rotated along the central terminal in 360 degrees, the central terminal and the annular contact of the outer terminal are maintained to respectively contact with the first terminal and the at least one second terminal by using the magnetic member and the mating magnetic member to attract with each other;

wherein the annularly magnetic region has a radius greater than a radius of the annular contact;

wherein the insulating body includes a first slot, an annular second slot, and an annular third slot, each of the first slot, the second slot, and the third slot has a center located at the first terminal; an end portion of the first terminal is arranged in the first slot, an end portion of the at least one second terminal is arranged in the second slot, and part of the mating magnetic member is arranged on a bottom of the third slot; the central terminal, the outer terminal, and the magnetic member are respectively inserted into the first slot, the second slot, and the third slot;

wherein the insulating body includes two positioning portions corresponding to the third slot, the mating magnetic member includes two C-shaped magnets, wherein two ends of each of the two C-shaped magnets are respectively connected to the two positioning portions, and the bottom of the third slot is formed by the two positioning portions and the two C-shaped magnets.

2. The electrically connecting device as claimed in claim 1, wherein each of the first terminal and the at least one second terminal is a pogo pin and has a movable contact portion, the contact portions of the first terminal and the at least one second terminal are respectively abutted against the central terminal and the annular contact of the outer terminal.

3. The electrically connecting device as claimed in claim 2, wherein a trough is formed on an end of the central terminal, and the contact portion of the first terminal is abutted against the trough; an annular groove is formed on an end of the annular contact of the outer terminal, and the contact portion of the at least one second terminal is abutted against the annular groove.

4. The electrically connecting device as claimed in claim 3, wherein each of the end of the central terminal and the end of the outer terminal is higher than the magnetic member, and the contact portions of the first terminal and the at least one second terminal are higher than the mating magnetic member with respect to a bottom of the first slot.

5. The electrically connecting device as claimed in claim 1, wherein the electrical connector is a 2-fold symmetrical structure with respect to the central terminal, and the mating connector is a 2-fold symmetrical structure with respect to the first terminal.

6. The electrically connecting device as claimed in claim 1, wherein the insulating base includes a circular slot having a center located at the central terminal; an end portion of the central terminal, the annular contact of the outer terminal, and an end portion of the magnetic member are arranged in the circular slot; the insulating body is detachably inserted into the circular slot; the magnetic member includes an annular structure having a center located at the central terminal, and the annular structure is configured to form the annularly magnetic region by cooperating with the mating magnetic member.

7. A mating connector for detachably connecting to an electrical connector, comprising:

an insulating body including a first slot, an annular second slot, and an annular third slot;

a mating terminal set installed to the insulating body and including a first terminal and at least one second terminal arranged apart from the first terminal, wherein an end portion of the first terminal is arranged in the first slot, and an end portion of the at least one second terminal is arranged in the second slot; and a mating magnetic member fixed in the insulating body, and part of the mating magnetic member arranged on a bottom of the third slot, wherein each of the first slot, the second slot, and the third slot has a center located at the first terminal;

wherein when the mating connector is rotated with respect to the electrical connector along the first terminal in 360 degrees, the mating magnetic member is configured to detachably attract with a magnetic member of the electrical connector to form an annularly magnetic region having a center located at the first terminal, so that the mating terminal set is maintained to contact with a terminal set of the electrical connector;

wherein the insulating body includes two positioning portions corresponding to the third slot, the mating magnetic member includes two C-shaped magnets, wherein two ends of each of the two C-shaped magnets are respectively connected to the two positioning portions, and the bottom of the third slot is formed by the two positioning portions and the two C-shaped magnets.

8. The mating connector as claimed in claim 7, wherein each of the first terminal and the at least one second terminal is a pogo pin and has a movable contact portion; the mating connector is symmetrical to the first terminal, and the third slot has a radius greater than a radius of the second slot.

* * * * *